US009511975B2

(12) United States Patent
Grenet et al.

(10) Patent No.: US 9,511,975 B2
(45) Date of Patent: Dec. 6, 2016

(54) RATCHET DEVICE FOR WINDING AND BLOCKING A DRAWSTRING

(71) Applicant: MAVIC S.A.S, Metz-Tessy (FR)

(72) Inventors: Adeline Grenet, Moye (FR); Duncan Ledingham, Annecy le Vieux (FR); Charly Signori, Annecy le Vieux (FR)

(73) Assignee: MAVIC S.A.S., Metz-Tessy (FR)

( * ) Notice: Subject to any disclaimer, the term of this patent is extended or adjusted under 35 U.S.C. 154(b) by 0 days.

(21) Appl. No.: 14/793,125

(22) Filed: Jul. 7, 2015

(65) Prior Publication Data

US 2016/0009524 A1 Jan. 14, 2016

(30) Foreign Application Priority Data

Jul. 8, 2014 (FR) ..... 14 01529

(51) Int. Cl.
*B65H 75/44* (2006.01)
*A43C 11/16* (2006.01)

(52) U.S. Cl.
CPC ..... *B65H 75/4492* (2013.01); *A43C 11/165* (2013.01); *B65H 75/4431* (2013.01); *B65H 2701/30* (2013.01); *B65H 2801/00* (2013.01)

(58) Field of Classification Search
CPC ..... A43C 11/165; A43C 11/16; A43C 11/20; B65H 75/4492; B65H 75/4431; B65H 2701/30; B65H 2801/00; Y10T 24/2183
USPC ..... 24/68 SK, 712.9
See application file for complete search history.

(56) References Cited

U.S. PATENT DOCUMENTS

| | | | | |
|---|---|---|---|---|
| 8,468,657 | B2 | 6/2013 | Soderberg et al. | |
| 9,072,341 | B2 | 7/2015 | Jungkind | |
| 2013/0014359 | A1* | 1/2013 | Chen | A43C 11/165 24/68 SK |
| 2013/0092780 | A1 | 4/2013 | Soderberg et al. | |

FOREIGN PATENT DOCUMENTS

| | | | |
|---|---|---|---|
| IT | 1 220 811 | B | 6/1990 |
| WO | WO-2010/059989 | A2 | 5/2010 |
| WO | WO-2014/082652 | A1 | 6/2014 |

* cited by examiner

*Primary Examiner* — Abigail Morrell
(74) *Attorney, Agent, or Firm* — Greenblum & Bernstein, P.L.C.

(57) ABSTRACT

The invention relates to a device for winding and locking a lace comprising a fixed support, a rotatable spool, a user-operable knob for driving the spool, and elements for blocking the spool. The blocking elements comprise at least one pawl having a retaining portion engaging at least one complementary projection of the support in the absence of a rotational force exerted by the user on the knob, a base rotationally driven when the knob rotates during loosening, a first bar carrying the retaining portion and being elastically deformable, an actuating portion carried by a second bar and away from the retaining portion, the pawl being configured so that, during loosening, the knob, via the actuating portion, disengages the retaining portion.

23 Claims, 3 Drawing Sheets

RATCHET DEVICE FOR WINDING AND BLOCKING A DRAWSTRING

CROSS-REFERENCE TO RELATED APPLICATION

This application is based upon French Patent Application No. FR 14/01529, filed Jul. 8, 2014, the disclosure of which is hereby incorporated by reference thereto in its entirety, and the priority of which is claimed under 35 U.S.C. §119.

BACKGROUND

1. Field of Invention

The invention relates to a device for winding and locking a drawstring. The invention finds a particular application within the context of lacing personal articles, such as garments, footwear, helmets, protective gears, by enabling lacing and, more generally, fast and accurate tightening.

2. Background Information

A number of devices for winding and locking drawstrings are known. Generally, such devices comprise a fixed support connected to the article, a spool for winding or unwinding the lace at its periphery, as well as mechanisms for locking the spool in a winding position. An element, typically a knob, is provided to enable the user of the article to control the locking of the spool in position.

For example, the document U.S. Pat. No. 8,468,657 discloses a lace winding and locking device comprising a spool and mechanisms for blocking its rotation. In this document, the blocking mechanisms are comprised of three thin engagement rods affixed to the spool at one of their ends, and the other end comprises a locking surface adapted to be embedded into teeth to block the rotation of the spool. Each engagement rod forms a pawl. This document also shows an unlocking surface carried by each of the engagement rods and adapted to come into contact with a stud driving the knob to cause the engagement rods to flex.

The presence of the three engagement rods makes it possible to balance the spool and to distribute rotational retention forces in three points. However, this has the disadvantage of rendering the construction of this system complex and hyperstatic.

In addition, this system has, in practice, proven to be relatively fragile and not suitable to withstand high tension force from the lace.

The fragility is further accentuated by the fact that the locking and unlocking surfaces are positioned in the vicinity of one another.

The patent IT-A-1 220 811 also discloses a device for winding and locking a lace, which partially solves the problem of fragility. This document provides a single massive pawl which comes into contact with peripheral teeth.

The mechanisms for disengaging the pawl from the teeth are formed by a cam surface provided on the pawl and positioned in the vicinity of the axis. Also provided is a spring pushing the pawl into position.

Such positioning is unfavorable in terms of moment, and the user must exert a relatively substantial torque to proceed with the loosening, making such loosening difficult. Furthermore, the presence of a spring in this device makes the construction of the device more complex and heavier. However, for certain applications, especially for garments or footwear, or similar articles, lightness is a very important parameter.

A problem underlying the invention is to design a device for winding and locking a drawstring, which is simple in design while having improved strength.

SUMMARY

To this end, the invention provides a device for winding and locking a drawstring on a personal article, such as a garment, an article of footwear, a helmet, or protective gear, the device comprising a fixed support, a spool rotatable in relation to the fixed support and designed to be connected to the lace for tightening or loosening it, a user-operable knob for driving the spool and elements for blocking the rotation of the spool, wherein the blocking elements comprise at least one pawl having:

- a retaining portion configured to engage, in a rotational locking position, at least one complementary projection affixed to the fixed support in the absence of rotational force exerted by the user on the knob;
- a base configured to be rotationally driven when the knob is rotated by the user in the loosening direction;
- a first bar carrying the retaining portion, the first bar being elastically deformable in order to cause, when deformed, the disengagement of the retaining portion from the at least one complementary projection, and, in a particular embodiment, the bar separates the retaining portion from the base;
- a portion for actuating the retaining portion, such actuating portion being carried by a second bar and being spaced away from the retaining portion;
- the pawl is configured so that, in a direction of rotation of the knob for loosening, the knob, via the actuating portion, causes the disengagement of the retaining portion from the at least one complementary projection.

This allows for easier unlocking while increasing the mechanical strength of the locking mechanisms. The contact surface of the retaining portion is at least as large as that provided by the device according to the closest prior art.

The pawl of the device according to the invention is biased by the knob in tightening and loosening, respectively, at two different locations spaced from one another: on the base carried by the first bar, on the one hand, and on the actuating portion carried by the second bar, on the other hand. Therefore, the forces are distributed over a large surface of the pawl, thereby reducing the risk of wear and rupture of the pawl.

In addition, moving the actuating portion away from the retaining portion increases the strength of the pawl, unlike the prior art document U.S. Pat. No. 8,468,657 in which the locking and unlocking surfaces are positioned in the vicinity of one another. Indeed, in the development of the invention, it was noticed that the fragility of the device described in the document U.S. Pat. No. 8,468,657 is due, at least partially, to the locking and unlocking surfaces being positioned next to one another.

Therefore, each engagement rod must be dimensioned such that the knob, when rotating, can make it flex easily. Such dimensioning makes the engagement rod fragile and not very capable of retaining a strong pull force of the lace. It follows that such a device cannot be subjected to an excessive tension of the lace.

Finally, the positioning of the actuating portion on the second bar, such as at the free end of the second bar in a particular embodiment, makes it possible to obtain a large lever arm that helps with the disengagement of the retaining portion from the complementary projection and thus facilitates the unlocking.

Optionally, the invention can have any of the preceding characteristics, which can be used separately or in combination.

According to an embodiment, the actuating portion is arranged in the vicinity of a first end of the second bar, the second bar comprising a second end through which the second bar is directly affixed to the first bar. This makes it possible to have a maximum lever arm for disengagement of the retaining portion from the complementary projection and, therefore, the unlocking of the spool.

According to an embodiment, the actuating portion is driven by a first drive member affixed to the knob. This enables the actuating portion to be driven in a limited and, therefore, more efficient manner.

According to an embodiment, the first drive member is in the form of a drive stop pushing the actuating portion carried by the second bar for unlocking the rotation of the knob, this push deforming the first bar in order to disengage the retaining portion from the complementary projection of the fixed support. The deformation of the first bar helps with the push of the drive stop by not opposing such push, and reduces friction and, therefore, wear on the stop and the member.

According to an embodiment, in the tightening direction, the drive stop is configured to push an actuating element affixed to the spool, in order to rotate the spool in this direction. This drive stop has the advantage of combining two functions, a function to push the drive member in the loosening direction, on the one hand, and a function to push an element of the spool in the tightening direction. Therefore, this is obtained with the same element, thereby resulting in a reduction in the number of elements required for the operation of the winding device, and also in a decrease in the total weight of the device, which is important when the user equipment should be light.

According to an embodiment that may be combined with the previous embodiment or implemented individually, the retaining portion is located in the vicinity of a first end of the first bar, the base being located in the vicinity of the second end of the first bar. Therefore, the forces are distributed over the entire pawl so that the pawl is biased on its entire periphery, making it less fragile.

According to an embodiment, in the loosening direction, the base is pushed by a second drive member affixed to the knob. This feature relates to the second drive that the knob exerts on the pawl at a different location from the first, which again makes it possible to distribute the forces over the entire pawl.

According to an embodiment, the pawl is affixed to the spool in the vicinity of the base, a fork carried by the pawl surrounding an affixation element carried by or affixed to the spool, the base forming one of the branches of the fork. Thus, the location in which the pawl is pushed by the second member is also the location in which it is affixed to the spool, which improves the transmission of forces from the knob to the pawl, and then to the spool.

According to an embodiment, the device comprises a buzzing element configured to rub against the inner periphery of the fixed support under the action of a rotational force exerted by a user on the knob in the loosening direction. The buzzing element serves to guide the user by sound during loosening, as the retaining portion does not then rub against the inner periphery of the fixed support.

This represents a significant advantage over a solution of the type described in the document U.S. Pat. No. 8,468,657. In this prior art solution, given that there is no contact between the engagement rod and the teeth when the knob is rotated in the loosening direction, the user has no audible indication of the length of the lace being unwound, as the engagement rod does not produce any noise from friction on the teeth.

According to an embodiment, the buzzing element is carried by an arm extending from the first bar, so that the deformation of the arm causes friction of the buzzing element against the inner periphery of the fixed support under the action of the noted rotational force exerted by a user on the knob in the loosening direction. In a particular embodiment, the aim comprises a first end through which it is affixed to the first bar and a second end which forms the buzzing element.

According to an embodiment, the device comprises a second drive member affixed to the knob and configured to push the base under the action of the noted rotational force exerted by a user on the knob in the tightening direction, and in which the second drive member also forms the noted spacing stop.

According to one embodiment, the arm is elastically deformable, a spacing stop carried by or affixed to the knob keeping the free end of the arm at a distance from the inner periphery of the fixed support, during tightening. This facilitates the positioning of the arm against the periphery of the fixed support so that it fulfills its buzzing role during loosening and its distancing from the contact with the periphery in order not to make any sound at the end of tightening.

According to a particular form of this embodiment, when the base is pushed by a second drive member affixed to the knob, the second drive member also forms the spacing stop. Similar to the first member, the second member fulfills two functions, thereby simplifying the device and reducing the number of elements required for its operation.

According to an embodiment, the complementary projection affixed to the fixed support is formed of notches in which is inserted a respective tooth carried by the retaining portion. The device is configured so that in the absence of rotational force exerted by a user on the knob in the loosening direction, at least one tooth carried by the retaining portion is inserted into a notch. For example, the number of teeth carried by the retaining portion may be between one and five. The contact between the complementary projection and retaining portion is therefore reinforced compared to that obtained according to the closest prior art between the engagement rod and the fixed support.

According to an embodiment, the first bar has, at least for its retaining portion, an external curvature oriented towards the fixed support and corresponding to that of the inner periphery of the fixed support. The first bar therefore has a configuration specifically designed to the inner periphery of the fixed support, which increases the engagement between the retaining portion and the complementary projection in the locking position of the spool.

According to an embodiment, the device comprises a single pawl, the single pawl being capable of carrying a single retaining portion. Compared to the closest state of the art that comprises three engagement rods, this represents a simplification of the device, resulting in production time savings and reduction in the number of constituent elements of the device.

According to an embodiment, the pawl is formed singularly. In particular, the base, the first and second bars, the actuating portion, and the retaining portion form a single piece. They are formed unitarily.

According to another aspect of the invention, there is provided a personal article, such as a garment, an article of footwear, a helmet, or an item of protective gear having at least one drawstring, comprising such a winding and locking device according to the invention for the at least one drawstring. The resulting tightening is fast and strong in position.

In the context of the invention, also provided is a device for winding and locking a drawstring for a personal article, such as a garment, an article of footwear, a helmet, an item of protective gear comprising a fixed support, a spool rotatable in relation to the fixed support, a spool drive knob, and elements for blocking the rotation the spool, with the elements blocking the rotation of the spool comprise a pawl, such pawl comprising a base, a retaining portion arranged so as to be away from the base on a first elastically deformable bar, and a portion for actuating the retaining portion carried by a second bar and being away from the retaining portion.

BRIEF DESCRIPTION OF DRAWINGS

Other features and advantages of the invention will become clearly apparent from the description, which is given below by way of non-limiting examples, with reference to the annexed drawings, in which:

FIG. 4 is a schematic representation of a side view of the device illustrated in FIG. 1, a cross section through which FIGS. 1-3 are taken.

DETAILED DESCRIPTION

Figure 1:
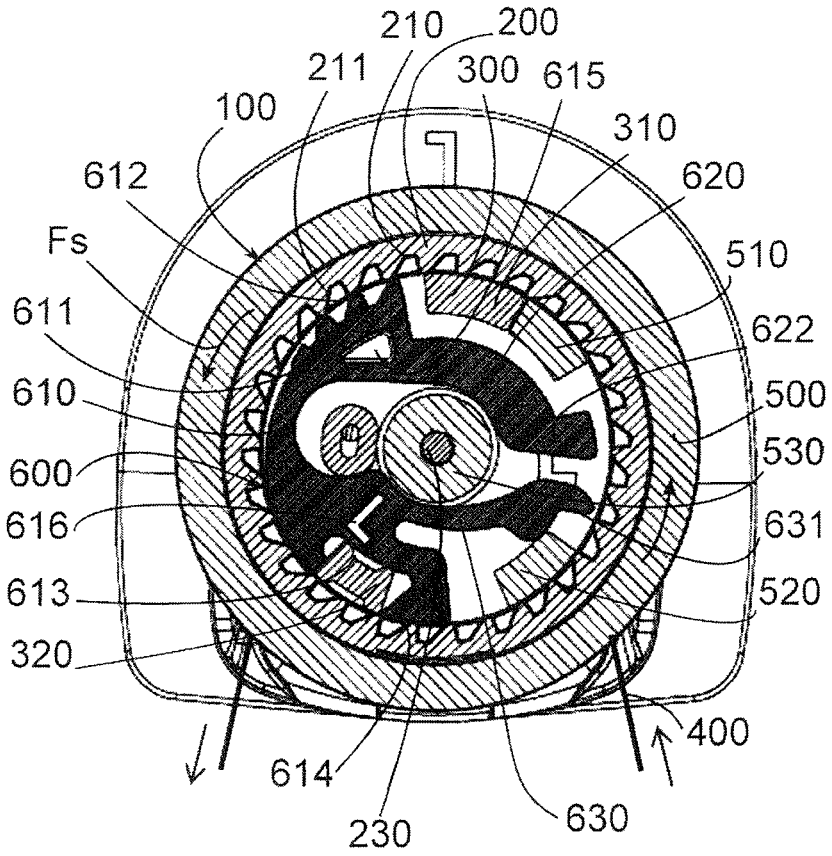
FIG. 1 is a schematic representation of a transverse cross-sectional view of an exemplary device for winding and locking a lace according to the invention, the device shown, in this figure, during tightening of the lace.

The drawings are given as examples and are not limiting of the invention. They are schematic functional diagrams intended to facilitate an understanding of the invention and are not necessarily to scale for practical applications.

With general reference to all of the figures of drawings, the invention relates to a device 100 for winding and locking a drawstring 400 for a personal article, such as a garment, an article of footwear, a helmet, an item of protective gear. The device 100 comprises a fixed support 200, a spool 300 rotatable in relation to the fixed support 200 and designed to be connected to the lace 400. The lace 400 is wound around the spool 300. A first end of the lace is fixed to the fixed support, the other end 401 is fixed to the spool. The first strand of lace, connected to the first end, is visible on the left in FIG. 1. The second strand seen on the right in FIG. 1 is wound around the spool 300 so that the two strands are simultaneously tightened and loosened, respectively, during the same rotation of the knob.

Figure 4:
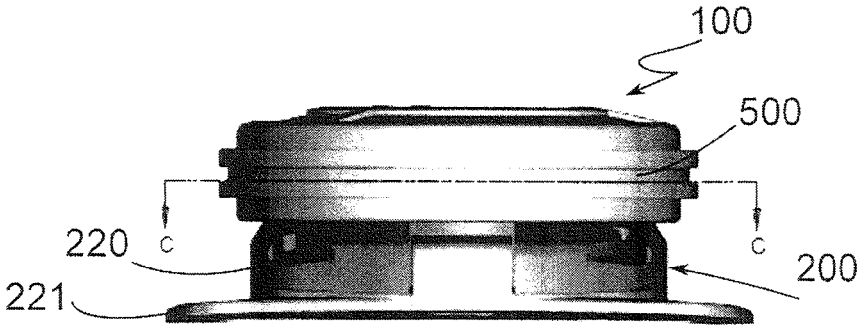

As illustrated in FIG. 4, the fixed support 200 rests on the personal article by being fixed thereto through a base plate 221. The fixed support 200 also comprises, among other elements, a cylindrical portion 220 carried by the base plate 221. With reference to all of the figures of drawings, the fixed support 200 may thus comprise a plurality of elements affixed to one another, removably or not, including a central axis 230 for a knob, which will be described later.

For example, the fixed support 200 may include a housing portion receiving the spool 300, the housing portion being capable of being removable from the base plate 221. It is this housing portion 200 that is referenced in FIGS. 1 to 3.

Figure 2:
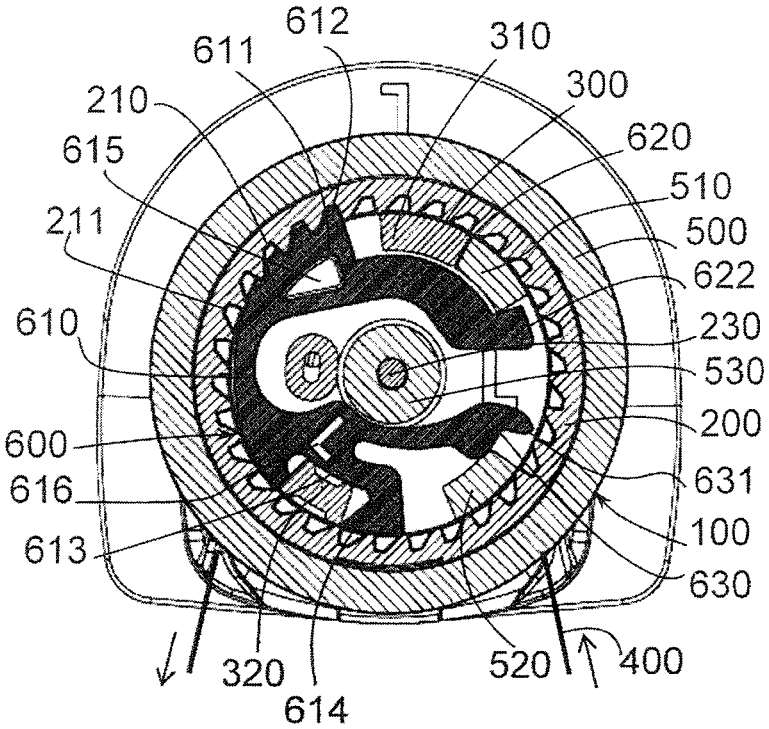
FIG. 2 is a schematic representation of a transverse cross-sectional view of the device illustrated in FIG. 1, the device shown, in this figure, in the position for blocking of the rotation of the spool.
Figure 3:
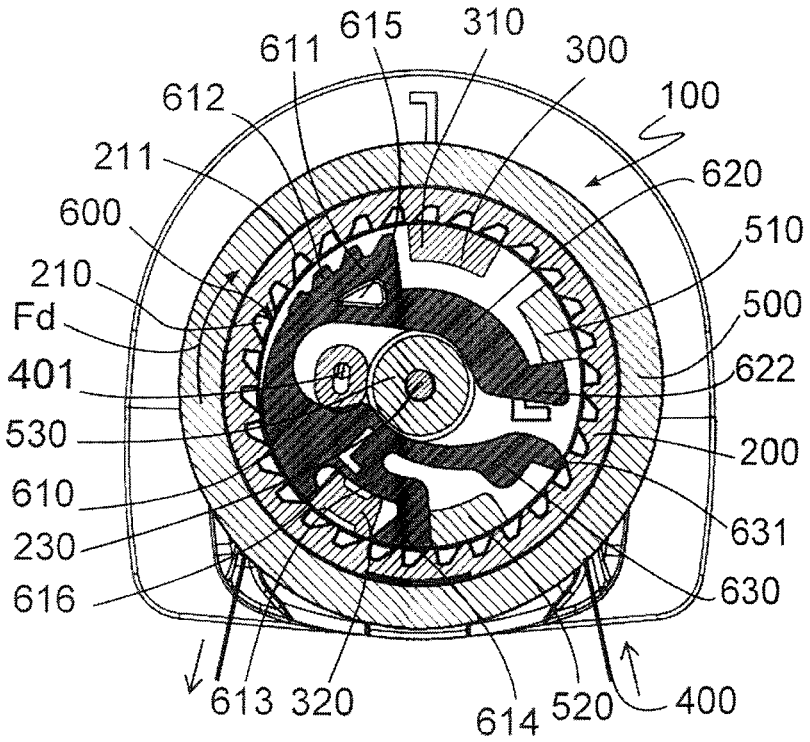
FIG. 3 is a schematic representation of a transverse cross-sectional view of the device illustrated in FIG. 1, the device shown, in this figure, during loosening of the lace.

With reference more particularly to FIGS. 1 to 3, the device 100 also includes a knob 500. This knob 500 is used to drive the spool 300 rotationally. The knob 500 substantially forms the contour of the device 100 by covering it in the area of its upper surface when the device 100 is fixed to the personal article and by having a substantially circular edge.

The knob 500 rotates about a central axis 230 affixed, removably or not, to the fixed support 200. For this, the knob 500 has a cylindrical housing 530 internal to the device 100 and receiving the central axis 230. The user can operate the knob 500 by grasping its side surfaces or via an element, such as a handle, carried by its upper surface and projecting from the upper surface and, perhaps, extending radially beyond the knob.

Also, the device 100 comprises elements 210, 600 for blocking the rotation of the spool 300. The elements 210, 600 blocking the rotation of the spool 300 comprise at least one pawl 600. The pawl or each pawl 600 carries a retaining portion 611 engaging at least one complementary projection 210 carried by the fixed support 200. In the embodiment illustrated in the figures of drawings, the pawl 600 is single and has a single retaining portion 611.

Still according to the illustrated exemplary embodiment, the aforementioned housing portion of the fixed support 200 is in the form of a crown and it houses the pawl 600 and the spool 300 in its interior. For simplification, this housing portion, which is part of the support, is referred to as the fixed support 200.

The inner periphery of the device 100 of the fixed support 200 has at least one notch 211 or, in a particular embodiment, a plurality of notches 211. The notches 211 are distributed over the entire inner periphery of the fixed support 200. Each notch 211, when facing the retaining portion 611 of the pawl, forms the complementary projection 210.

The retaining portion 611 has at least one tooth 612 that can penetrate into the at least one notch 211 of the complementary projection 210. By way of example, and without limitation, the number of teeth 612 can vary from one to five.

FIGS. 1 to 3 show four teeth 612 for the retaining portion 611. The notches 211 are angled by presenting a side substantially radial to the device 100, this side being oriented in the loosening direction of the spool 300. The other side is angled so that the inlet of the notches 211 is larger than their bottom.

The retaining portion 611 is therefore configured to engage, in a locking configuration, with at least the complementary projection 210 affixed to the fixed support 200 in order to block the rotation of the spool 300 in the absence of a rotational force exerted by a user on the knob 500. This retaining portion 611 is also configured to enable the rotation of the spool 300 in relation to the fixed support 200 under the action of a rotational force exerted by a user on the knob 500 in a tightening direction and in a loosening direction, by elastic deformation as will be described below.

In the exemplary embodiment illustrated in FIGS. 1 to 3, the tightening direction corresponds to a counterclockwise rotation of the knob 300. This direction is indicated by the arrows Fs in FIG. 1. The loosening direction corresponds to the clockwise rotation of the knob. This direction is illustrated by the arrow Fd in FIG. 3.

The blocking position, also designated the blocking configuration, corresponds to the case in which the user does not rotationally drive the knob 500. In this case, the lace 400 remains locked when tension is applied thereto.

The composition of the pawl 600 is described below.

The pawl includes a first bar 610 carrying the retaining portion 611. The first bar 610 is elastically deformable radially, in relation to the axis of rotation of the spool, to disengage the retaining portion 611, including its teeth 612, from the complementary projection 210 affixed to the fixed support 200 when a user action is transmitted thereto through the knob 500.

By bar is meant an elongated member having two ends; this member is not necessarily straight.

In the embodiment shown in the drawing figures, the first bar 610 has, on its side opposite the fixed support 200, a curved shape corresponding to the curvature of the inner periphery of the fixed support 200, at least for the retaining portion 611 that it carries.

The fact that the bar refers to a generally elongated member also applies to a second bar 620 to be described below.

The deformation of the first bar 610 causes the radial disengagement of the retaining portion 611 with respect to the at least one complementary projection 211 carried by the fixed support 200.

To deform the first bar 610, when the knob 500 is driven in the loosening direction, and therefore to disengage the retaining portion 611, an actuating portion 622 is provided on the pawl 600.

In the embodiment illustrated in the drawing figures, the actuating portion 622 is arranged so as to be spaced away from the retaining portion 611. The actuating portion 622 is carried by a second bar 620. In this embodiment, the second bar 620 is attached through one of its ends to the first bar 610, in the vicinity of the retaining portion 611. The first 610 and second 620 bars are not in the extension of one another but form an angle of approximately 90° therebetween.

The second bar 620 can carry the actuating portion 622 in the vicinity of its free end opposite the end that is attached to the first bar 610, this free end being capable, for example, of forming the actuating portion 622.

The pawl 600 is configured so that, in one direction of rotation of the knob 500 corresponding to the loosening, the knob 500 displaces the actuating portion 622, such displacement of the actuating portion 622 causing the disengagement of the retaining portion 611 from the complementary projection 210 of the fixed support 200.

The actuating portion 622 is displaced under the action of a first drive member 510 affixed to the knob 500. This first drive member 510 is configured to be rotationally driven directly or indirectly by the knob 500.

In the embodiment of the figures of drawings, the actuating member is in the form of a first drive stop 510. The drive stop 510 pushes the actuating portion 622 and, therefore, the second bar 620, thereby deforming the first bar 610 and disengaging the retaining portion 611 by pulling the retaining portion 611 of the pawl, including its teeth 612, from the complementary projection 210, including its notches 211, of the fixed support 200. A cavity 615 is provided in the first bar 610 in the vicinity of the retaining portion 611, which enables it to be flexible.

As mentioned above, the second bar 620 can be connected to a first end of the first bar 610, the retaining portion 611 being carried by the first bar 610 in the vicinity of the first end. In the vicinity of the opposite end of the first bar 610, so-called second end and, therefore the end of the bar 610 not carrying the retaining portion 611, the first bar 610 of the pawl 600 carries a base 614 configured to be rotationally driven directly or indirectly by the knob 500, in one direction of rotation of the knob 500 corresponding to the loosening.

In the loosening direction, the base 614 is pushed by a second drive member 520 affixed to the knob 500.

In the embodiment shown in the figures of drawing, the pawl 600, via the first bar 610, is rotationally affixed to the spool 300, in the vicinity of the base 614. This is achieved by a fork 613 carried by the first bar 610 of the pawl 600 surrounding an affixation element 320 carried by or affixed to the spool 300. As illustrated in the figures of drawings, the base 614 forms one of the branches of the fork 613, this arm being capable of being the outermost in relation to the first bar 610.

The fork 613 located in the vicinity of the base 614 clamps the affixation element 320 between two arms. The affixation element 320 makes it possible to transfer the rotation of the knob 500 to the spool 300.

Branching from the base 614 in the vicinity of its second end, the first bar 610 is also extended by a buzzer-forming arm 630, the free end 631 of the arm 630 rubbing against the inner periphery of the fixed support 200 under the action of a rotational force exerted by a user on the knob 500. The free end 631 may then be brought into contact with the inner periphery of the fixed support 200 carrying the notches 211 and makes a sound when the free end 631 slides against the inner periphery of the fixed support 200 carrying at least one notch 211, for example during the action of a rotational force exerted by a user on the knob 500, and especially during loosening. As can be seen in FIGS. 1-3, the free end 631 of the arm 630 forms a buzzing element that it circumferentially spaced away from the teeth 612 of the retaining portion 611 of the pawl and, more particularly in the illustrated embodiment, substantially diametrically spaced from the teeth of the retaining portion of the pawl.

The user can thus easily control the loosening undertaken.

The arm 630 may be brought into contact with the inner periphery of the fixed support, and then moved away from this periphery. A cavity 616 may be provided in the first bar 610, between the base 614 and the fastening of the arm 630 to the first bar 610, in order to provide a certain elasticity to the arm 630 allowing it to easily take the positions of contact with the fixed support 200 and of spacing from the fixed support 200, respectively.

The embodiment illustrated shows a second possible function of the drive member 520 affixed to the knob 500 as a stop for spacing the free end 631 of the arm 630 from the inner periphery of the fixed support 200, this second stop being referred to as the spacing stop. This spacing stop 520 gets close to the buzzer-forming arm 630 by moving away from the base 614 during tightening and prevents the free end 631 of the buzzer 630 from coming into contact with the inner periphery of the fixed support 200, and therefore from emitting a sound when the free end 631 slides along the inner periphery by maintaining this end 631 away from the periphery. This makes it possible not to use the buzzer-forming arm as a clicking noise may be obtained by rubbing the teeth 312 on the projections of the crown.

With reference to FIGS. 1 to 3, the various phases of tightening, locking, and then loosening the lace 400 by the winding and locking device 100 will now be described. This particular embodiment is not limiting.

In FIG. 1, during tightening, the user of the article provided with at least one lace with a winding and locking device 100 according to the invention rotates the knob 500 in the direction of the tightening arrow Fs, only one of which is referenced in this figure of drawing.

During this rotation of the knob 500, the first and second drive members 510, 520, which are affixed to the knob 500, follow this rotation. The first drive member 510 comes into abutment with the actuating member 310 affixed to the spool 300 and rotationally pushes this actuating element 310 in the direction of the tightening arrow Fs. The spool 300 is then driven in the tightening direction.

The second drive member 520 does not then perform a driving function but serves as spacing stop for the free end 631 of the buzzer-forming arm 630 by moving this end 631 away from the inner periphery of the fixed support 200. Indeed, it is not necessary to use the buzzer to assess the number of notches 211 of the inner periphery of the fixed support 200 already passed in the rotation. Indeed, a noise is already emitted by the teeth 612 of the retaining portion 611 which have been in contact with notches 211 of the inner periphery of the fixed support 200, which enables the user to estimate the rotation performed by the spool 300 and, therefore, the tightening.

During tightening, the buzzer-forming arm 630 and the second bar 620 are in contact at diametrically opposite points of the cylindrical housing 530 for receiving the knob 500 surrounding the central axis 230 of rotation of the device 100. This enables the pawl 600 to be centered in the device 100.

In FIG. 2, the tightening is completed. The user no longer rotates the knob 500. The pawl 600, and therefore the spool 300, are locked in position due to the interaction of the retaining portion 611 of the pawl 600 with the complementary projection 210 at the inner periphery of the fixed support 200, the teeth 612 of the retaining portion 611 having penetrated into the notches 211 of the complementary projection 210.

As shown in FIG. 2, the spool 300 is rotationally affixed to the pawl 600 via the affixation element 320 inserted in the fork 613, in the vicinity of the base 614 carried by the first bar 610 of the pawl 600. However, although such affixation is permanent, a temporary affixation of the spool 300 to the pawl 600 may also be envisioned.

In the locking position, the second drive member 520 of the knob 500 is still interposed between the free end 631 of the buzzer-forming aim 630 and the inner periphery of the fixed support 200. The first drive member 510 of the knob 500 is always in abutment with the actuating element 310 affixed to the spool 300 but no longer acts on this element 310.

A tension force exerted on either one of the strands of the lace 400 is then transferred to the spool in the form of a rotational force, a rotational force that is blocked by the pawl 600, rotationally affixed to the spool, on the one hand, and affixed to the fixed support 200 by means of cooperation of the pawl 600 with the projections of the fixed support 200, on the other hand. The lace 400 is thus locked even under the action of strong traction.

As shown in FIG. 3, during loosening, the user rotates the knob 500 in the direction of the loosening arrow Fd. The first drive member 510 of the knob 500 ceases to be in abutment with the actuating member 310 and rotates in the direction of the arrow Fd to get in contact with the actuating portion 622 at the free end the second bar 620. The drive member 510 pushes the actuating portion 622 in the loosening direction, thereby causing the deformation of the first bar 610 and the disengagement of the retaining portion 611 out of the complementary projection; the blocking is then eliminated.

The second drive element 520 also follows the rotation of the knob 500 and no longer performs its function of spacing stop for the free end 631 of the buzzer-forming arm 630. The free end 631 of the arm 630 then rubs against the inner periphery of the fixed support 200, thereby enabling the arm 630 to perform its buzzing function and to guide the user with a sound to evaluate the loosening.

The second drive element 520 having ceased to be interposed between the free end 631 and the inner periphery of the fixed support 200 comes in contact with the base 614 towards the end of the first bar 610.

This second drive member 520 then performs a function of rotationally driving the base 614 and, therefore, of the pawl 600 and of the spool 300 along the loosening arrow Fd, the spool 300 being affixed to the base 614 by its affixation element 320 received in the fork 613 of the pawl 600.

From the foregoing description, one can easily recognize that the invention provides a robust, simple, and reliable solution for providing easy and accurate tightening and loosening, as well as having a high tensile strength in the locking position.

The described embodiment corresponds to a cable winder whose tightening is carried out by counterclockwise rotation. For example, this winder could be positioned on a left shoe. A symmetrical embodiment in which tightening is carried out by clockwise rotation is also within the scope of the invention.

The invention is not limited to the embodiment described above and extends to all of the embodiments covered by the claims.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A device for winding and locking a drawstring, the device comprising:

a fixed support;

a spool designed to be connected to the drawstring, the spool being configured to be rotatable about an axis in relation to the fixed support selectively in each of a tightening direction and a loosening direction;

a user-operable knob connected to drive the spool in the tightening and loosening directions;

blocking elements configured to block rotation of the spool, the blocking elements comprising at least one pawl and at least one complementary portion of the fixed support;

each of the at least one pawl is a pawl comprising:

a base configured to be rotationally driven by the knob when the knob is rotated by the user in the loosening direction;

a retaining portion configured to engage, in a rotational blocking position in an absence of a rotational force exerted by the user on the knob, the at least one complementary portion of the fixed support;

a first bar carrying the retaining portion of the pawl and separating the retaining portion from the base;

the first bar being radially elastically deformable so as to cause, when deformed, a radial disengagement of the retaining portion from the at least one complementary portion of the fixed support;

an actuating portion configured to actuate the retaining portion of the pawl during rotation of the spool in the loosening direction;

a second bar spaced from the retaining portion of the pawl, the second bar carrying the actuating portion of the pawl;

the pawl being configured so that, during rotation of the knob in the loosening direction of the spool via the actuating portion of the pawl, the knob causes the radial disengagement of the retaining portion of the pawl from the at least one complementary portion of the fixed support.

2. The device according to the claim 1, wherein:

the second bar has a first end and a second end;

the actuating portion is arranged in a vicinity of the first end of the second bar; and the second end of the second bar is directly affixed to the first bar.

3. The device according to claim 2, wherein:

the knob comprises a first drive member positioned in relation to the actuating portion of the pawl to drive the actuating portion in the loosening direction of the spool.

4. The device according to claim 2, wherein:

the knob comprises a first drive member positioned in relation to the actuating portion of the pawl to push the actuating portion in the loosening direction of the spool to cause the radial disengagement of the retaining portion of the pawl from the at least one complementary portion of the fixed support.

5. The device according to claim 4, wherein:

in the tightening direction of the spool, the first drive member is configured to push a spool-actuating element affixed to the spool to cause rotation of the spool in the tightening direction.

6. The device according to claim 1, wherein:

the retaining portion is located in a vicinity of a first end of the first bar, the base being located in a vicinity of a second end of the first bar.

7. The device according to claim 6, wherein:

in the loosening direction of the spool, the base is pushed by a second drive member affixed to the knob.

8. The device according to claim 7, wherein:

the pawl is affixed to the spool in a vicinity of the base of the pawl;

a fork is carried by the pawl and surrounds an affixation element carried by or affixed to the spool; and the base forms a branch of the fork.

9. The device according to claim 1, further comprising:

a buzzing element configured to rub against an inner periphery of the fixed support under action of a rotational force exerted by the user on the knob in the loosening direction.

10. The device according to claim 9, wherein:

the buzzing element is carried by an elastically deformable arm extending from the first bar so that deformation of the arm causes friction of the buzzing element against the inner periphery of the fixed support in the loosening direction of the spool.

11. The device according to claim 10, further comprising:

a spacing stop carried by or affixed to the knob;

the buzzing element is carried by a free end of the elastically deformable arm; and the spacing stop is configured to maintain the free end of the elastically deformable arm at a distance from the inner periphery of the fixed support during any rotation of the spool in the tightening direction.

12. The device according to claim 11, wherein:

the spacing stop comprises a second drive member affixed to the knob;

the second drive member is configured to push the base by means of a rotational force exerted by the user on the knob in the loosening direction.

13. The device according to claim 10, wherein:

the arm and the buzzing element are configured not to rub against the inner periphery of the fixed support during rotation of the spool in the tightening direction.

14. The device according to claim 9, wherein:

the buzzing element is circumferentially spaced away from the retaining portion of the pawl.

15. The device according to claim 1, wherein:

the at least one complementary portion affixed to the fixed support comprises a plurality of notches;

the device is configured so that, in absence of the rotational force exerted by the user on the knob in the loosening direction, at least one tooth carried by the retaining portion is inserted into at least one of the notches.

16. The device according to claim 15, wherein:

said at least one tooth carried by the retaining portion consists of a number of teeth, said number of teeth being between two teeth and five teeth;

each of the teeth is configured to engage within a respective one of the plurality of notches.

17. The device according to claim 16, wherein:

the pawl being configured so that, during rotation of the knob in the loosening direction of the spool via the actuating portion of the pawl, the knob causes radial disengagement of all of the plurality of teeth carried by the retaining portion of the pawl from the plurality of notches of the at least one complementary portion of the fixed support.

18. The device according to claim 1, wherein:

at least the retaining portion of the first bar has an outer curvature oriented toward the fixed support corresponding to a curvature of an inner periphery of the fixed support.

19. The device according to claim 1, wherein:

the pawl is formed in one piece.

20. A personal article comprising:

at least one drawstring and a winding and locking device, the device comprising:

a fixed support;

a spool designed to be connected to the at least one drawstring, the spool being configured to be rotatable about an axis in relation to the fixed support selectively in each of a tightening direction and a loosening direction;

a user-operable knob connected to drive the spool in the tightening and loosening directions;

blocking elements configured to block rotation of the spool, the blocking elements comprising at least one pawl and at least one complementary portion of the fixed support;

each of the at least one pawl is a pawl comprising:

a base configured to be rotationally driven by the knob when the knob is rotated by the user in the loosening direction;

a retaining portion configured to engage, in a rotational blocking position in an absence of a rotational force exerted by the user on the knob, the at least one complementary portion of the fixed support;

a first bar carrying the retaining portion of the pawl and separating the retaining portion from the base;

the first bar being radially elastically deformable so as to cause, when deformed, radial disengagement of the retaining portion from the at least one complementary portion of the fixed support;

an actuating portion configured to actuate the retaining portion of the pawl during rotation of the spool in the loosening direction;

a second bar spaced from the retaining portion of the pawl, the second bar carrying the actuating portion of the pawl;

the pawl being configured so that, during rotation of the knob in the loosening direction of the spool via the actuating portion of the pawl, the knob causes the radial disengagement of the retaining portion of the pawl from the at least one complementary portion of the fixed support.

21. A device for winding and locking a drawstring, the device comprising:

a fixed support;

a spool designed to be connected to the drawstring, the spool being configured to be rotatable about an axis in relation to the fixed support selectively in each of a tightening direction and a loosening direction;

a user-operable knob connected to drive the spool in the tightening and loosening directions;

blocking elements configured to block rotation of the spool, the blocking elements comprising:

at least one complementary portion of the fixed support; and at least one pawl consisting of one pawl; and the pawl comprising:

a base configured to be rotationally driven by the knob when the knob is rotated by the user in the loosening direction;

a retaining portion configured to engage, in a rotational blocking position in an absence of a rotational force exerted by the user on the knob, the at least one complementary portion of the fixed support;

a first bar carrying the retaining portion of the pawl and separating the retaining portion from the base;

the first bar being radially elastically deformable so as to cause, when deformed, a radial disengagement of the retaining portion from the at least one complementary portion of the fixed support;

an actuating portion configured to actuate the retaining portion of the pawl during rotation of the spool in the loosening direction;

a second bar spaced from the retaining portion of the pawl, the second bar carrying the actuating portion of the pawl;

the pawl being configured so that, during rotation of the knob in the loosening direction of the spool via the actuating portion of the pawl, the knob causes the radial disengagement of the retaining portion of the pawl from the at least one complementary portion of the fixed support.

22. The device according to claim 21, wherein:

the one pawl of the device is a unitary one-piece pawl.

23. A device for winding and locking a drawstring, the device comprising:

a fixed support;

a spool designed to be connected to the drawstring, the spool being configured to be rotatable about an axis in relation to the fixed support selectively in each of a tightening direction and a loosening direction;

a user-operable knob connected to drive the spool in the tightening and loosening directions;

blocking elements configured to block rotation of the spool, the blocking elements comprising:

at least one complementary portion of the fixed support; and a pawl consisting of one pawl; and the pawl comprising:

a base configured to be rotationally driven by the knob when the knob is rotated by the user in the loosening direction;

a retaining portion consisting of one retaining portion configured to engage, in a rotational blocking position in an absence of a rotational force exerted by the user on the knob, the at least one complementary portion of the fixed support;

a first bar carrying the retaining portion of the pawl and separating the retaining portion from the base;

the first bar being radially elastically deformable so as to cause, when deformed, a radial disengagement of the retaining portion from the at least one complementary portion of the fixed support;

an actuating portion configured to actuate the retaining portion of the pawl during rotation of the spool in the loosening direction;

a second bar spaced from the retaining portion of the pawl, the second bar carrying the actuating portion of the pawl;

the pawl being configured so that, during rotation of the knob in the loosening direction of the spool via the actuating portion of the pawl, the knob causes the radial disengagement of the retaining portion of the pawl from the at least one complementary portion of the fixed support.

* * * * *